United States Patent [19]

Merkel et al.

[11] 4,060,420

[45] Nov. 29, 1977

[54] SULFONYLACETATE ACTIVATOR-STABILIZER PRECURSOR

[75] Inventors: Paul Barrett Merkel; Hans Gway Ling, both of Rochester, N.Y.

[73] Assignee: Eastman Kodak Company, Rochester, N.Y.

[21] Appl. No.: 712,459

[22] Filed: Aug. 6, 1976

[51] Int. Cl.[2] ..... G03C 1/02; G03C 5/24; G03C 1/34

[52] U.S. Cl. ..... 96/114.1; 96/48 HD; 96/109; 96/6 GT

[58] Field of Search ..... 96/114.1, 76, 48 HD, 96/109, 6 GT; 427/56

[56] References Cited

U.S. PATENT DOCUMENTS

| | | | |
|---|---|---|---|
| 3,457,078 | 7/1969 | Riester | 96/109 |
| 3,649,280 | 3/1972 | King et al. | 96/95 |
| 3,669,670 | 6/1972 | Haist et al. | 96/114.1 |
| 3,955,982 | 5/1976 | Van Allan et al. | 96/114.1 |

OTHER PUBLICATIONS

Research Discl., 12/75 # 14049, Activator-Stabilizers in Heat Dev. Photog., Dickerson et al.

*Primary Examiner*—David Klein
*Assistant Examiner*—Louis Falasco
*Attorney, Agent, or Firm*—Richard E. Knapp

[57] ABSTRACT

An activator-stabilizer precursor compound having an acid portion which is an alpha-sulfonylacetate is useful in a photographic composition which is responsive to heat for processing. The activator-stabilizer precursors are characterized in that their acid byproducts have reduced toxicity and volatility and are substantially inert in a processed photographic element.

28 Claims, No Drawings

SULFONYLACETATE ACTIVATOR-STABILIZER PRECURSOR

BACKGROUND OF THE INVENTION

This invention relates to certain activator-stabilizer precursor compounds for use in photographic materials for processing with heat. More particularly, this invention relates to such compounds wherein the acid portion of the compound is an alpha-sulfonylacetate. One aspect of the invention relates to heat developable and heat stabilizable photographic elements comprising the described alpha-sulfonylacetate compounds. Another aspect relates to photographic compositions containing these compounds. A further aspect relates to a heat activatable photographic processing composition containing the described activator-stabilizer precursors.

DESCRIPTION OF THE STATE OF THE ART

It is known in the art to provide photographic elements that are heat developable. That is photographic elements are known wherein a latent image can be developed by heating the element. Typically, such elements contain photosensitive silver halide, a developing agent, a developing agent activator precursor and, typically, a stabilizer precursor. Upon development by the application of heat, the developer activator and the stabilizer are released from their respective precursors. Development of the photographic image and stabilization of the element occur substantially simultaneously as the result of two competing reactions.

A heat developable element is known wherein an image is developed, for instance, by a developing agent which is activated by the decarboxylation products of organic acids. This is, for example, described in U.S. Pat. No. 3,220,846 of Sagura and Tinker issued Nov. 30, 1965. An example of such a heat developable material contains piperidine trichloroacetate which decarboxylates with heat to produce piperidine, carbon dioxide and chloroform. The piperidine activates the developer in the element while the chloroform, which is volatile at processing temperatures, and the carbon dioxide are released into the binder of the element.

Other heat developable photographic and, in some cases, heat stabilizable photographic materials are described, for example, in U.S. Pat. No. 3,301,678 of Humphlett, Johnson and Haist, issued Jan. 31, 1967; British Pat. No. 1,161,777 published Aug. 20, 1969; U.S. Pat. No. 3,152,904 of Sorensen et al., issued Oct. 13, 1964; British Pat. No. 1,131,108 published Oct. 23, 1968; U.S. Pat. No. 3,392,020 of Yutzy et al., issued July 9, 1968; German Pat. No. 888,045 published Aug. 27, 1953; and British Pat. No. 930,572 published July 3, 1963.

It is also known to incorporate stabilizer precursors in heat developable photographic elements for processing with heat. Certain sulfur-containing compounds may be heat activated to stabilize an image in a photographic element, as described, for instance, in U.S. Pat. No. 3,301,678 of Humphlett, Johnson and Haist, issued Jan. 31, 1967. The sulfur-containing compound breaks down or "cleaves" at elevated temperatures to form a compound that combines with the silver halide in the unexposed and undeveloped areas of the emulsion. The resulting silver mercaptide is more stable than silver halide to light, atmospheric and ambient reducing conditions. Typically, the compounds described in this patent are isothiuronium compounds.

Certain bis-isothiuronium compounds having an intermediate ureylene or ether moiety between the isothiuronium moieties are also known as activator stabilizers, as described, for example, in U.S. Pat. No. 3,669,670 of Haist and Humphlett, issued June 13, 1972. Heating of these compounds releases both a development activator and a stabilizer moiety. These compounds, however, have resulted in one or more of the disadvantages: (1) larger concentrations of processing chemicals are required than desired, (2) in many cases they result in obnoxious odors upon heat processing, and (3) less than desired post-processing image stability is observed.

In copending application U.S. Ser. No. 551,182 of D. G. Dickerson and P. B. Merkel filed Feb. 19, 1975 entitled "Activator-Stabilizers in Heat Developable Photographic Materials and Processes" and in *Research Disclosure,* Volume 140, December 1975, Item 14049, certain 2-amino-2-thiazolium carboxylates are described as activator-stabilizer precursors in photographic materials. Upon heating, such compounds release an agent that is capable of activating a developer and are also capable of stabilizing a silver halide image. Although useful as activator-stabilizer precursors for heat developable photographic elements, these carboxylate compounds have certain drawbacks. The byproducts formed by the decarboxylation of these compounds are undesirably volatile at processing temperatures. These volatile byproducts are released into the emulsion binder along with carbon dioxide. Examples of the byproducts that are given off by the specific compounds disclosed in that application are chloroform, acetaldehyde and methyl cyanide. These compounds, which can escape into the environment, are highly toxic gases. In addition to their toxicity, these gases along with the carbon dioxide released by the decarboxylation may form undesirable bubbles in the photographic material.

Thus, there has been a need for activator-stabilizer precursor compounds which have byproducts which have reduced toxicity and volatility. These byproducts should not contribute to bubble information and also not significantly adversely effect the processed element. The prior art provides no guidance for the selection of an acid anion which has decarboxylation byproducts having the desired combination of properties.

SUMMARY OF THE INVENTION

According to this invention, these desired properties are provided in a heat developable and heat stabilizable photographic silver salt material and process by an activator-stabilizer precursor having a base portion and an acid portion wherein the acid portion is an alpha-sulfonylacetate. Such an activator-stabilizer precursor provides, upon heating, the required activation and stabilization without the deleterious physical effects of the volatile byproducts of decarboxylation. In addition, the acid byproducts of the alpha-sulfonylacetate activator-stabilizer precursors have been found to have desired reduced toxicity and to be substantially inert in the processed element. The photographic materials according to the invention also have improved keeping properties, as illustrated, for example, by following Example 10.

DETAILED DESCRIPTION OF THE INVENTION

The activator-stabilizer precursors of the present invention are ionic compounds formed by the reaction of an acid and a base or by ion exchange using existing ionic compounds. As used herein, "acid portion" refers to the anionic part of the compound that originated in the acid and similarly "base portion" refers to the cationic part of the compound that originated in the base. The following reaction sequence illustrates the preparation of compounds within the present invention:

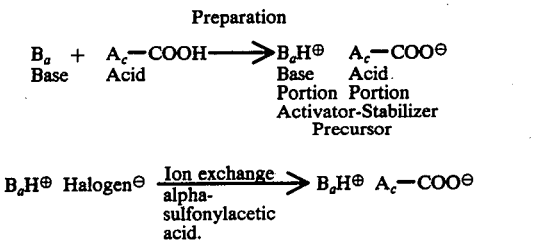

The exact mechanism by which the activator-stabilizer precursors function according to the invention is not fully understood. However, it is believed that, upon heating, the activator-stabilizer precursor forms an activator-stabilizer as illustrated by the following:

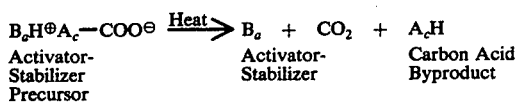

The activator-stabilizer precursor compounds as described are represented by the formula:

$$Q_mA_w$$

wherein Q is a base portion, especially a protonated basic nitrogen containing moiety, and A is an acid anion which is an alpha-sulfonylacetate; and wherein *m* and *w* are integers, depending on the nature of the cation and anion, sufficient to form a neutral compound. A neutral compound as described herein is intended to mean a compound that has a net charge of zero. That is, the compound is neutralized because the number of acid groups is balanced by the number of basic groups with none in excess. The term "protonated" herein is intended to mean that one or more hydrogen ions ($H^+$) are bound to an amine moiety forming a positively charged species. Typically *m* is 1 to 4 and *w* is 1 to 2. For example, when Q is a bivalent cation and A is a univalent anion, *m* is 1 and *w* is 2. Preferably, A is an alpha-sulfonylacetate represented by the formula:

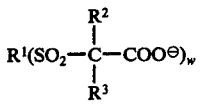

wherein *w* is 1 or 2; $R^1$ is alkyl, such as alkyl containing 1 to 6 carbon atoms, including methyl, ethyl, propyl and butyl; aryl, such as aryl containing 5 to 10 carbon atoms, including phenyl, naphthyl and pyridyl; or carboxymethyl when *w* is 1 and alkylene containing 1 to 6 carbon atoms, such as methylene, ethylene and propylene, alkylidene, such as ethylidene and isopropylidene, or arylene, especially arylene containing 6 to 10 carbon atoms, such as phenylene and phenylethylidene, when *w* is 2; and $R^2$ and $R^3$ may be the same or different and individually represent hydrogen, alkyl containing 1 to 6 carbons, or aryl, such as aryl containing 6 to 10 carbon atoms, including phenyl.

Alkyl, aryl, alkylene, and arylene are intended herein to include alkyl, aryl, alkylene and arylene that are unsubstituted or contain substituents which do not adversely affect the sensitometric or other desired properties of the photographic materials as described. Suitable substituent groups include, for example hydroxyl, carboxamido and carbamoyl.

Particularly useful alpha-sulfonylacetates include theylenebis(sulfonylacetate), methylenebis(sulfonylacetate) and phenylsulfonylacetate.

Q can be any of a variety of protonated basic nitrogen containing moieties which do not significantly adversely affect the desired properties, such as sensitometric properties, of the described photographic materials. Preferably Q is selected from the group consisting of the following formulas:

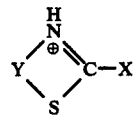

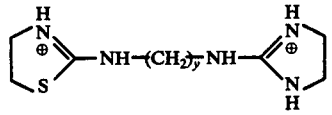

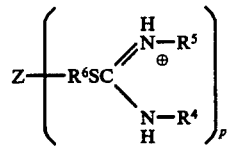

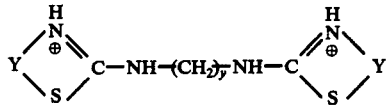

wherein

Y is alkylene containing 2 or 3 chain carbons, such as

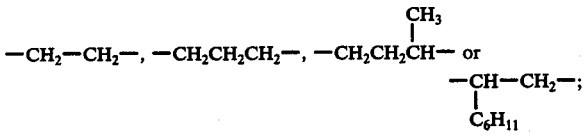

X is $SR^7$ or $NHR^8$, wherein $R^7$ is aminoalkyl containing 2 to 6 carbon atoms, such as aminoethyl, aminopropyl or aminobutyl;

$R^8$ is hydrogen, alkyl containing 1 to 20 carbon atoms, such as methyl, ethyl, butyl, cyclohexylmethyl, dodecyl and nonadecyl, preferably 1 to 12 carbon atoms; or phenyl; and aminoalkyl, such as aminoalkyl containing 2 to 6 carbon atoms, such as aminoethyl and aminopropyl;

*p* is 1 or 2;

when *p* is 1, Z is chosen from substituents that render the stabilizer nonvolatile and odorless, including

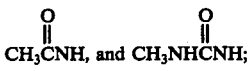

when $p$ is 2, Z is a divalent linking group selected from groups such as

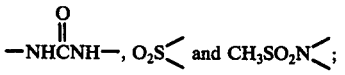

$R^6$ is alkylene containing 2 to 12 carbon atoms, such as ethylene or propylene, or phenylene;

$R^5$ and $R^4$ can be the same or different and are individually selected from the group consisting of hydrogen, alkyl, such as alkyl containing 1 to 6 carbon atoms, for example, methyl, ethyl and butyl; or $R^5$ and $R^4$ taken together represent alkylene containing 2 or 3 carbon atoms; and $y$ is 1 to 8.

Selection of an optimum activator-stabilizer compound or combination of compounds as described will depend upon a variety of factors, such as the particular image desired, processing conditions, particular photographic silver salt, other components of the photographic material, degree of desired image stability and the like. One selection test, for example, is described in following Example 1. In this example a compound within the above formula can be included in place of the described sulfonylacetate compound. If the results of the test provide similar results to those of Example 1, the sulfonylacetate compound is considered satisfactory, that is it is considered satisfactory if an image is developed and the minimum density of the image increases no more than about 0.05 after 1000 foot candle hours of light exposure.

Typically useful activator-stabilizer precursor compounds according to the present invention include compounds represented by the following formulae:

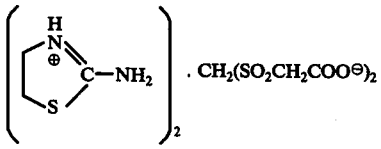

bis(2-amino-2-thiazolinium) methylenebis(sulfonylacetate)

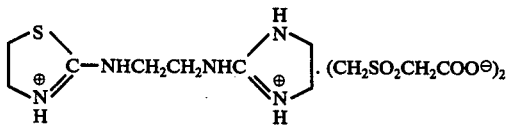

N-(2-thiazolino)-N'-(2-imidazolino)ethylene diamine ethylenebis(sulfonylacetate). (This compound can also be named as 2-{2-[(2-thiazolinium-2-yl)amino]ethylamino}-2-imidazolinium ethylenebis(sulfonylacetate).)

The activator-stabilizer 1,3-bis[2S-(N,N'-ethyleneisothiourea)ethyl]urea ethylenebis(sulfonylacetic acid) represented by the formula:

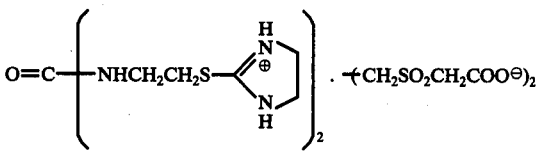

is especially useful according to the invention. (This compound can also be named as $\beta,\beta'$-ureylenebis(2-ethylthio-2-imidazolinium) ethylenebis(sulfonylacetate).)

Other useful alpha-sulfonylacetate activator-stabilizer compounds according to the invention include:

1. 2-amino-2-thiazolinium phenylsulfonylacetate:

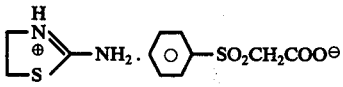

2. bis(2-amino-5,6-dihydro-4H-thiazine) methylenebis(sulfonylacetate):

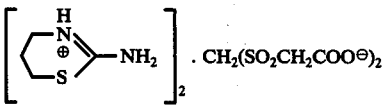

(This compound can also be named as bis(2-amino-5,6-dihydro-4H-1,3-thiazin-3-ium)methylenebis(sulfonylacetate).

3. 2-benzylamino-2-thiazolinium phenylsulfonylacetate 4. bis(2-amino-2-thiazolinium) isopropylidenebis (sulfonylacetate)

5. $\beta,\beta'$-methylsulfonyliminobis(2-ethylthio-2-imidazolinium) methylenebis(sulfonylacetate)

6. 1,3-bis(2-amino-2-thiazolinyl)propane ethylenebis-(sulfonylacetate)

7. N-(2-thiazolino)-N'-(2-imidazolino)butylenediamine ethylenebis(sulfonylacetate)

$\beta,\beta'$-methylsulfonyliminobis(ethylisothiuronium) methylenebis(sulfonylacetate) has also been tested in a heat developable and heat stabilizable material according to the invention. In some compositions this compound can provide less then desired results due to facile release of mercaptan.

8. N,N'-dithiazolino compounds, that can also be named as N,N'-di(2-thiazolinium-2-yl) compounds, represented by the formula:

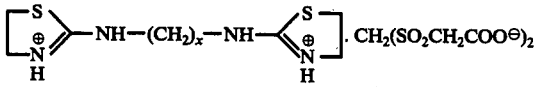

wherein $x$ is 2, 3, 4, 5, 6 or 8.

Combinations of activator-stabilizer precursors as described can be used according to the invention if desired.

Some of the activator-stabilizer precursor compounds have limited solubility in aqueous formulations and may require some added solvents in preparation of photographic compositions.

The alpha-sulfonylacetate activator-stabilizer precursor compounds of the invention are characterized by the non-volatility of the acid byproduct of the heat induced decarboxylation of the compound. Volatility of the acid byproducts of the compounds of the present invention is conveniently measured by thermogravimetric scan analysis. This analysis involves the weight loss measurement of a sample as a function of temperature at a given rate of temperature increase. Compounds of the present invention are particularly useful if the acid byproduct of the heat induced decarboxylation of the alpha-sulfonylacetate compound undergoes less than 10% weight loss between about 30° C and 180° C using a rate of temperature increase of about 40° C per minute. A detailed description of thermogravimetric analysis can be found in *Instrumental Methods of Analysis,* Willard, Merritt and Dean; Van Nostrand, 1965 Chapter 17.

The activator-stabilizer compounds of the invention are made by methods known to those skilled in the art. The ammonium or 2-amino-2-thiazolium salts (also named 2-amino-2-thiazolinium salts) can be prepared by the reaction of an alpha-sulfonylacetic acid with a substituted amine in an inert organic solvent. Suitable solvents include acetonitrile, ether, ethyl acetate, ethanol and the like. Solvent mixtures can also be used. The alpha-sulfonylacetic acid and substituted amine are typically mixed in about stoichiometric concentrations. The reaction mixture can be heated in a solvent if desired until reaction is complete. An excess of the alpha-sulfonylacetic acid can be used to provide improved yields of the desired product. The remaining activator-stabilizer compounds of the present invention can be prepared from their corresponding carbonate or halide salts through ion exchange. The compounds according to the invention can be purified by techiques known in the art such as recrystallization from a suitable solvent such as ethyl acetate, chloroform, methanol, ligroin and the like.

Compounds of the invention wherein the base portion is as defined in described formula III, may be prepared by ion exchange of the corresponding halide salt with an alpha-sulfonylacetate, as described. The corresponding halide salt is prepared by first reacting, in a suitable solvent, a diamine with 2-methylthio-2-imidazoline halide, the preparation of which is described in S. Aspinall and E. Bianco, *J. Amer. Chem. Soc.,* 73, 602 (1951). The product of this reaction is then reacted with 2-methylthio-2-thiazoline halide, the preparation of which is described in A. McKay et al., *J. Amer. Chem. Soc.,* 80, 3339 (1958), to form the halide of the illustrated base portion. The preparation of N-(2-thiazolino)-N'-(2-imidazolino) ethylenediamine ethylenebis(sulfonyl acetate) is an example of the described synthesis: A slurry of 23.0 g of N-(2-thiazolino)-N'-(2-imidazolino)ethylenediamine dihydroiodide and 14.0 g. of ethylenebis(sulfonylacetic acid) in 300 ml methanol is heated to 40° C and then treated dropwise, very slowly with 12.0 g of propylene oxide (300% excess). A clear solution results after addition of 3 g of the oxide and further addition causes crystallization of the desired salt. The resulting slurry is stirred for 30 minutes at 40° C and then warmed to 50° C. Addition of 75 ml of water results in solution. The solution is filtered hot and on cooling crystals of the desired product having a melting point of 135° - 138° C result. The product can be purified further.

Compounds wherein the base portion is as defined in described formula V can be prepared in a similar manner using the appropriate starting materials.

One embodiment of the invention is: in a heat developable and heat stabilizable photographic element comprising a support having thereon, in reactive association, (a) a photographic silver salt, typically a photographic silver halide, (b) a photographic silver salt developing agent such as a silver halide developing agent, (c) a binder and (d) a stabilizing concentration of an activator-stabilizer precursor having a base portion and an acid portion the improvement wherein the acid portion is an alpha-sulfonylacetate as described.

A silver salt developing agent, typically a silver halide developing agent, is useful in the photographic materials and processes as described to provide a desired developed image. Useful silver salt developing agents, typically silver halide developing agents, include for example, polyhydroxybenzenes such as hydroquinone developing agents, including, for example, hydroquinone, alkyl-substituted hydroquinones such as tertiary butylhydroquinone, methylhydroquinone, 2,5-dimethylhydroquinone and 2,6-dimethylhydroquinone; catechols and pyrogallol; chlorohydroquinone or dichlorohydroquinone; alkoxy substituted hydroquinones such as methoxyhydroquinone or ethoxyhydroquinone; methylhydroxynaphthalene; methyl gallate; aminophenol developing agents such as 2,4-diaminophenols and methylaminophenols; ascorbic acid developing agents such as ascorbic acid, ascorbic acid ketals and ascorbic acid derivatives; hydroxylamine developing agents such as N,N-di(2-ethoxyethyl)hydroxylamine; pyrimidine developing agents; 31 -pyrazolidone developing agents such as 1-phenyl-3-pyrazolidone and 4-methyl-4-hydroxymethyl-1-phenyl-3-pyrazolidone, such as described in British Pat. No. 930,572 published July 3, 1963; hydroxytetronic acid and hydroxytetronimide developing agents; reductone developing agents, such as anhydrodihydropiperidino hexose reductone; and furanone developing agents such as 3,4-dihydroxy-5-phenyl-2,5-dihydro-2-furanone; and the like. Combinations of developing agents can be useful if desired.

The term silver salt developing agent as used herein is intended to also include developing agent precursors. That is, the term includes compounds, known as precursors, which form a developing agent, such as upon exposure to suitable energy such as light or heat.

The photographic materials and compositions as described contain a photographic silver salt, preferably photographic silver halide due to its high degree of photosensitivity. Useful photographic silver salts other than photographic silver halide include, for example, certain silver triazoles and silver aminotriazoles. Useful photographic silver halides include, for example, silver chloride, silver bromide, silver bromoiodide, silver chlorobromoiodide or mixtures thereof. The photographic silver halide can be coarse or fine-grain. The composition containing the photographic silver halide can be prepared by any of the well-known procedures in the photographic art such as single-jet emulsions, double-jet emulsions, such as Lippmann emulsions, ammoniacal emulsions, thiocyanate or thioether ripened emulsions and the like such as described in U.S. Pat. No. 2,222,264 of Nietz et al., issued Nov. 14, 1940; U.S. Pat. No. 3,332,069 of Illingsworth, issued May 15, 1967 and U.S. Pat. No. 3,271,157 of McBride, issued Sept. 6, 1966. Surface image silver halide materials can be useful or internal image silver halide materials such as those described in U.S. Pat. No. 2,592,250 of Davey et al., issued Apr. 8, 1952; U.S. Pat. No. 3,206,313 of Porter et al., issued Sept. 14, 1965; U.S. Pat. No. 3,367,778 of Berriman et al., issued Feb. 6, 1968 and U.S. Pat. No. 3,447,927 of Bacon et al., issued June 3, 1969. If desired, mixtures of surface image and internal image silver halide materials can be useful as described in U.S. Pat. No. 2,996,382 of Luckey et al., issued Apr. 15, 1961. Silver halide materials useful can be regular grain silver halide materials such as the type described in Klein and Moisar, "Journal of Photographic Science," Volume 12, Number 5, September-October, 1964, pages 242–251 and German Pat. No. 2,107,118. Negative type silver halide materials can be useful as well as direct positive silver halide materials. The activator-stabilizer precursors of the present invention are particularly useful with silver bromide and silver bromoiodide emulsions. A range of concentration of photographic silver salt can be used in the photographic materials of the invention. Typically a concentration of photographic silver salt is used that, when coated on a support, provides a photographic element containing about 1 to about 30 mg $Ag/dm^2$.

It is useful in some cases when a pure silver chloride emulsion is used in heat developable photographic materials to add an iodide compound, such as an alkali metal or alkaline earth metal iodide compound, to the emulsion. This can provide higher maximum density in a developed image with such an emulsion. For example, a photographic material can be prepared by mixing the following components:

| | |
|---|---|
| gelatin | 200 mg |
| surfactant | 10 mg |
| bis(2-amino-2-thiazoline) methylenebis(sulfonylacetate) | 500 mg |
| 4-methyl-4-hydroxymethyl-1-phenyl 3-pyrazolidone | 100 mg |
| silver chloride fine grain gelatino emulsion | 100 mg |

An aqueous solution of potassium iodide in an amount equal to 18 mg of KI/mole of silver can be added to the silver chloride emulsion prior to mixing the emulsion with other of the described components.

The resulting photographic composition can be coated on a suitable support to provide a heat developable photographic element. After imagewise exposure of this element a developed and stabilized image can be provided by merely uniformly heating the photographic material, such as by heating the element for about 2 to 30 seconds at a temperature within the range of about 140° to 170° C.

The silver halide photographic materials useful herein can be washed or unwashed to remove soluble salts after precipitation of the silver halide; can be chemically sensitized; can contain development modifiers that function as speed-increasing compounds; and can contain antifoggants and emulsion stabilizers; as described in the *Product Licensing Index,* Volume 92, December, 1971, publication 9232.

The photograhic materials according to the invention can also contain hardeners, antistatic layers, plasticizers, lubricants, coating aids, matting agents, brighteners, absorbing and filter dyes which do not adversely affect the properties of the heat-developable and heat-stabilizable materials of the invention. These addenda are described, for example, in the above Product Licensing Index publication.

The heat-developable and heat-stabilizable photographic materials as described can contain various vehicles and binders alone or in combination. The alpha-sulfonylacetate activator-stabilizer precursors can be preformed as described above or can be formed in situ merely by mixing the acid and base in the presence of a solvent and suitable vehicle. Suitable vehicle materials include both naturally-occurring substances such as proteins, for example, gelatin, gelatin derivatives, cellulose derivatives, polysaccharides such as dextran, gum arabic and the like; and synthetic polymeric materials such as water soluble polyvinyl compounds like poly(-vinyl pyrrolidone), acrylamide polymers and the like. The photographic layers and other layers of the elements of the invention, such as overcoat layers, interlayers and subbing layers can also contain alone or in combination with the described vehicles, other synthetic polymeric vehicle compounds such as dispersed vinyl compounds, such as in latex form, and particularly those which increase the dimensional stability of the photographic materials. Useful synthetic polymers include those described in the above Product Licensing Index publication. Effective polymers include water insoluble polymers of alkyl acrylates and methacrylates, acrylic acid, sulfoalkyl acrylates or methacrylates and those which have crosslinking sites which facilitate hardening or curing as well as those having recurring sulfobetaine units as described in Canadian Pat. No. 774,054 issued Dec. 19, 1967.

The photographic and others layers of an element according to the invention can be coated on a variety of supports. Typical supports include those which are resistant to adverse changes in structure and do not adversely affect the sensitometric properties of the described photographic materials at the processing temperatures employed. Typical supports include cellulose ester film, poly(vinyl acetal) film, poly(ethylene terephthalate) film, polycarbonate film and related films and resinous materials, as well as glass, paper, metal and the like. Typically, a flexible support is employed, especially a paper support.

The photographic elements and compositions of the invention can contain spectral sensitizing dyes to confer additional sensitivity to the light sensitive silver salts, especially light sensitive silver halide materials of the invention. Useful spectral sensitizing dyes are described, for example, in the above Product Licensing Index publication. Combinations of these dyes can be useful if desired. In addition, supersensitizing addenda which do not absorb visible light may be useful in the described materials. The sensitizing dyes and other addenda useful in materials according to the invention can be incorporated into these materials from water solutions or suitable organic solvent solutions. The sensitizing dyes and other addenda can be added using various procedures such as described in the above Product Licensing Index publication.

The heat-developable and heat-stabilizable layer and other layers of photographic elements as described can be coated by various coating procedures. If desired, two or more layers may be coated simultaneously using procedures known in the photographic art.

The described alpha-sulfonylacetate compounds are useful in a variety of physical locations in a photographic element according to the invention. The alpha-sulfonylacetate compounds are useful in one or more layers of the described photographic element such as in the silver halide composition layer and/or an overcoat layer and/or a layer between the silver salt composition layer and a support. It is ncessary that the described alpha-sulfonylacetate compounds be contiguous to the photographic silver salt to be stabilized and the developing agent or developing agent precursor to be activated. This contiguous location enables desired interaction between the photographic silver compound and the developing agent or developing agent precursor upon heating of the photographic material. The term "in reactive association" as employed herein is intended to mean that the compound is in such a location enabling the desired interaction.

Various saccharides can be useful in combination with the described alpha-sulfonylacetate compounds. Useful saccharides are described, for example, in British Pat. No. 930,572 published July 3, 1963. The concentration of saccharide which is useful can vary depending upon the desired image, other components of the photographic material, the particular alpha-sulfonylacetate compound, processing conditions and the like. A concentration of about 0.01 to about 20 moles of saccharide per mole of described alpha-sulfonylacetate compound is useful.

The described alpha-sulfonylacetate compounds are useful in a variety of heat-developable and heat-stabilizable photographic compositions. Accordingly, another embodiment of the invention is a heat-developable and heat-stabilizable photographic composition comprising (a) a photographic silver salt, typically photographic silver halide, (b) a photographic silver salt developing agent, typically a silver halide developing agent, and (c) an activator stabilizer which is an alpha-sulfonylacetate as described. The photographic composition is typically a photographic silver halide emulsion.

The described alpha-sulfonylacetate compounds are also useful in photographic silver salt processing compositions such as in silver halide developers, stabilizing compositions, fixing compositions, hardeners and the like which enable use of the alkali release and stabilizer release properties of the compounds. For these reasons, another embodiment of the invention is a heat activatable photographic silver salt processing composition comprising a silver salt developing agent, as described, and an activator-stabilizer precursor present in an amount sufficient to stabilize the silver salt to be processed when said processing composition is heated. The amount of activator-stabilizer precursor most useful, will depend upon several factors, such as the particular alpha-sulfonylacetate compound, the processing temperature, desired image and the like. A useful amount is typically about 0.2 mole to about 4 moles of the alpha-sulfonylacetate compound per moles of silver salt developing agent in the photographic silver salt processing composition.

A useful heat activatable photographic silver halide processing composition within this embodiment comprises (a) a phenolic silver halide developing agent, such as a hydroquinone, (b) a 1-phenyl-3-pyrazolidone silver halide developing agent, such as 4-methyl-4-hydroxymethyl-1-phenyl-3-pyrazolidone and (c) an activator-stabilizer precursor as described, which is present in an amount sufficient to stabilize the silver halide to be processed when the processing composition is heated. The processing composition may also contain a binder such as an ethyl cellulose binder.

The photographic compositions and elements as well as the photographic silver salt processing compositions according to the invention can contain a silver halide developing agent as described. The concentration of silver halide developing agent which is useful is within the range of about 0.2 mole to about 4 moles of developing agent per mole of photographic silver compound in the photographic material to be processed. Selection of an optimum concentration of developing agent will depend, for example, upon such factors as other components of the material, desired image, processing conditions and the like.

Because the described alpha-sulfonylacetate activator-stabilizer precursor compounds are useful as activator precursors for developing agents and as stabilizer precursors, no other stabilizers or stabilizer percursors are needed in the described compositions of the invention. However, other stabilizers or stabilizer precursors can be used with the photographic materials and processes of the invention if desired. For example, certain stabilizer precursors which form a stable silver complex upon heating in the described elements, such as those described in U.S. Pat. No. 3,669,670 of Haist and Humphlett, issued June 13, 1972 can be useful in combination with the compounds described herein. Halogen-containing stabilizer precursors, such as tetrabromobutane or 2-tribromomethylsulfonylbenzothiazole, can also be useful in combination with the desired alpha-sulfonylacetate compounds.

After exposure of a photographic material, according to the invention, an image in the photographic material comprising in reactive association (a) a photographic silver salt, (b) a photographic silver salt developing agent, and (c) an alpha-sulfonylacetate activator-stabilizer precursor as described, present in an amount sufficient to stabilize the silver salt when said element is heated, can be developed and stabilized by merely heating the element to a temperature within the range of about 90° to about 200° C, usually within the range of about 110° to about 180° C, until the desired image is developed and stabilized.

A variety of imagewise exposure means and energy sources can be useful for providing a latent image in the described photographic material. The exposure means can be, for example, a light source, a laser, an electron beam, X-rays and the like.

An image is typically developed by heating the material to a temperature within the described range for about 1 to about 60 seconds, such as about 1 to about 30 seconds.

By increasing or decreasing the time of heating, a higher or lower temperature within the described range is useful.

Processing is usually carried out under ambient conditions of pressure and humidity. Pressures and humidity outside normal atmospheric conditions can be useful if desired; however, normal atmospheric conditions are preferred.

Various means are useful for providing the necessary heating as described. The photographic element according to the invention can be brought into contact with a simple hot plate, iron, rollers, dielectric heating means or the like.

Small concentrations of moisture can be present during processing such as the concentrations of moisture present in conventional photographic paper supports at atmospheric conditions, such as at about 25° C and 40% relative humidity.

While it is not necessary, an activator, also known as an alkali-release agent, base-release agent or an activator precursor, can be useful with the described alpha-sulfonylacetate compounds. An activator as described herein is intended to mean an agent which aids the developing agent at processing temperatures with the described alpha-sulfonylacetate compounds to develop a latent image in a photographic silver salt contiguous to the developing agent. Useful activator precursors are described, for example, in Belgian Pat. No. 709,967 published Feb. 29, 1968. Examples of useful activator precursors include guanidinium salts, such as guanidinium trichloroacetate, diguanidinium glutarate, succinate, malonate and the like; quaternary ammonium malonates such as piperazinium or piperidinium malonate; amino acids, such as 6-amino caproic acid and glycine; and the like. Other activator precursors are described, for example, in British Pat. No. 998,949 published July 21, 1965.

The alpha-sulfonylacetate compounds, as described, can be useful in light sensitive diazotype materials. The two component light sensitive diazotype materials can contain at least one light sensitive diazonium salt and at least one coupling compound which can react with the diazonium salt typically in an alkaline medium to form an azo dye. In addition, various other addenda such as ultraviolet absorbers, acid stabilizers (to prevent premature coupling of the diazonium salt and the coupler), can be present with the alpha-sulfonylacetate compounds as described. A diazotype element containing the described alpha-sulfonylacetate compound can be imagewise exposed to activating radiation through an original. The impending light decomposes the diazonium salt. Thereafter, development of the exposed diazotype material can be accomplished by treatment with an alkaline medium. In lieu of externally supplied alkaline medium, such as ammonia, the described alpha-sulfonylacetate compounds are useful when incorporated into the diazotype materials as alkaline releasing development precursors. The alpha-sulfonylacetate compounds as described when heated, such as up to a temperature within the range of about 120° to about 160° C, generate alkaline material useful for initiating the coupling reaction in the diazotype material. Simple heating produces desired image development without requiring an outside source of ammonia or other alkaline material. An example of a diazo type material according to this embodiment comprises a water soluble cellulose acetate binder, cyclohexosulfonic acid, para-diazodiethylaniline zinc chloride, 6,7-dihydroxy-2-naphthalene sodium sulfonate, a surfactant, and a compound selected from the group consisting of bis(2-amino-2-thiazolinium) methylenebis(sulfonylacetate) and N-(2-thiazolino)-N'-(2-imidazolino) ethylene diamine ethylene-bis(sulfonylacetate), and combinations of these alpha-sulfonylacetate compounds. This material is coated on a polyester film support at a desired wet thickness. After drying, the resulting photographic material can be exposed imagewise to ultraviolet radiation until the diazonium salt is decomposed in the light-struck areas. The exposed element can then be overall heated to a temperature up to about 200° C for a period of time to provide a developed dye image.

The concentration of the described alpha-sulfonylacetate compounds which is useful in the photographic materials, according to the invention, can vary depending upon such factors as the desired image, processing conditions, particular alpha-sulfonylacetate compound, and the like. The stabilizing concentration, as described, is within the range of about 0.2 to about 4 moles of the activator-stabilizer precursor per mole of the photographic silver salt. A concentration of alpha-sulfonylacetate compound in a photographic element or composition as described is typically about 0.5 to about 2.0 moles of the alpha-sulfonylacetate compound per mole of silver in the element or composition.

The following examples are included for a further understanding of the invention.

EXAMPLE 1

The following materials were mixed:

| | |
|---|---|
| gelatin | 200 mg |
| surfactant (Surfactant 10 G which is an alkylphenoxypolyglycidol sold by Olin Corporation, U.S.A.) | 10 mg |
| bis(2-amino-2-thiazoline) methylene-bis(sulfonylacetate) | 500 mg |
| 4-methyl-4-hydroxymethyl-1-phenyl-3-pyrazolidone | 100 mg |
| silver bromoiodide gelatino emulsion (2.5 mole percent iodide, 0.1 micron reduction sensitized silver bromo-iodide) | 100 mg (Ag) |
| water to make | 10 ml |

The resulting composition was coated at 100 microns wet thickness on a poly(ethylene terephthalate) film support and permitted to dry. Samples of the resulting heat developable and heat stabilizable photographic element were sensitometrically exposed to provide a developable latent image. The elements were then heat processed for 10 seconds at 150°–160° C. A developed and stabilized image having a purple tone was produced in the element. The processed image experienced an increase in minimum density of less than 0.05 after 1000 foot candle hours of light exposure. The image had a maximum density of 2.2, a minimum density of 0.2 and a gamma of 5.0. Reciprocal speed, measured at a density of 0.1 above fog, was 110 ergs/cm$^2$.

Unexposed and unprocessed samples were incubated in a black paper envelope for 2 weeks at 38° C and 58% relative humidity. No significant adverse sensitometric changes resulted from this incubation.

EXAMPLE 2

This is a comparative example.

Bis(2-amino-2-thiazoline) methylenebis(sulfonylacetate) was decarboxylated to yield 2-amino-2-thiazoline, carbon dioxide and bis(methylsulfonyl)methane. A sample of the bis(methylsulfonyl)methane was placed on a Perkin-Elmer model TGS-1 thermobalance. The sample underwent less than a 1% weight loss between 30° and 180° C using a scan rate of 40° C per minute.

By comparison, the carbon acid byproducts of the specific activator-stabilizers disclosed in *Research Disclosure,* Volume 140, December, 1975, Item 14049 of D. G. Dickerson and P. B. Merkel are liquids which boil well below 180° C and therefore would undergo substantially total weight loss in the above-defined thermogravimetric analysis.

EXAMPLES 3–5

The procedure according to Example 1 was repeated in each of following Examples 3, 4, and 5 substituting the indicated activator-stabilizer for the bis(2-amino-2-thiazoline) methylenebis(sulfonylacetate) with the maximum and minimum density results given. The developed images were light stable.

EXAMPLE 3

600 mg 2-amino-2-thiazolinium phenylsulfonylacetate. Dmin = 0.1 Dmax = 1.7.

EXAMPLE 4

500 mg bis(2-amino-5,6-dihydro-4H-thiazine) methylenebis(sulfonylacetate). Dmin = 0.1 and Dmax = 2.2.

EXAMPLE 5

550 mg 1,3-bis[2S-(N,N'-ethylene-isothiuronium ethyl]-urea methylenebis(sulfonylacetate) (formed in situ). Dmin = 0.2 and Dmax = 1.6.

EXAMPLE 6

The procedure according to Example 1 was repeated substituting a sulfur and gold sensitized silver bromoiodide gelatino emulsion for the silver bromoiodide emulsion of Example 1. A developed and stabilized image was formed in the element after imagewise exposure and heating as described in Example 1. The images had a minimum density of 0.1 and a maximum density of 1.8.

EXAMPLE 7

The procedure according to Example 1 was repeated except that the silver bromoiodide was spectrally sensitized with anhydro-5,5',6,6'-tetrachloro-1,1'-diethyl-3,3'-di(3-sulfobutyl) benzimidazolocarbocyanine hydroxide. Upon processing a useful image was produced having a reciprocal speed, measured at 0.1 above fog, of 50 ergs/cm$^2$. The activator-stabilizer appeared to have no significant adverse affect on spectral sensitivity of the photographic material.

EXAMPLE 8

The following components were mixed and then coated on a poly(ethylene terephthalate) film as a support:

| | |
|---|---|
| gelatin | 21.5 mg/dm$^2$ |
| surfactant (Surfactant 10 G) | 1.0 mg/dm$^2$ |
| 4-hydroxymethyl-4-methyl-1-phenyl-3-pyrazolidone | 10.8 mg/dm$^2$ |
| N-(2-thiazoline)-N'-(2-imidazolino) ethylene diamine ethylenebis(sulfonylacetate) | 37.6 mg/dm$^2$ |
| ethylenebis(sulfonylacetic acid) | 2.1 mg/dm$^2$ |
| silver bromoiodide gelatino emulsion (2.5 mole % iodide, 0.12 micron grain size) | 10.8 mg/dm$^2$ (silver) |

The resulting photothermographic material after it was permitted to dry was overcoated with 5.4 mg/dm$^2$ of poly(methyl methacrylate) from dichloromethane to produce a transparent, abrasion resistant surface. The resulting element was imagewise exposed to light to provide a latent image and then processed by heating the element for 15 seconds at 160° C. A developed and stabilized image having a purple tone resulted having a minimum density of 0.12 and a maximum (diffuse) density of 1.7.

The example was repeated with the exception that the photographic element, prior to immediate exposure, was incubated for 1 week at 38° C and 50% relative humidity. Upon imagewise exposure and processing after the incubation period, a developed image was produced having a minimum density of 1.6.

This example illustrates application of an especially useful activator-stabilizer according to the invention because the activator-stabilizer of this example does not generate a volatile amine upon heating in the described photographic material.

EXAMPLE 9

The following components were mixed with water and then coated on a polyethylene coated paper support having a layer of an acrylamide polymer on the polyethylene layer:

| | |
|---|---|
| gelatin | 21.5 mg/dm$^2$ |
| surfactant (Surfactant 10 G) | 1.0 mg/dm$^2$ |
| 4-hydroxymethyl-4-methyl-1-phenyl-3-pyrazolidone | 8.6 mg/dm$^2$ |
| N-(2-thiazoline)-N'-(2-imidazolino) ethylene diamine ethylenebis-(sulfonylacetate) | 32.3 mg/dm$^2$ |
| ethylene bis(sulfonylacetic acid) | 1.6 mg/dm$^2$ |
| 4-phenyl-3-imino-1,2,4-triazolidine-5-thione represented by the formula: 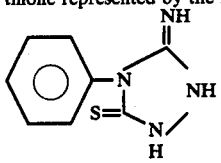 | 0.1 mg/dm$^2$ |

The resulting coating was permitted to dry to form a heat developable photograhic element. The element was imagewise exposed to light to form a latent image. It was then heated for 20 seconds at 160° C to provide a developed image. The developed image had a brown tone with a maximum density of 1.45 and a minimum density of 0.1.

The example was repeated with the exception that the photographic element prior to imagewise exposure and heating was incubated for 2 weeks at 38° C and 50% relative humidity. Upon imagewise exposure and heating after this incubation period, a developed image was produced having no significant change in sensitometric results from those observed for the element that was not incubated as described.

EXAMPLE 10

This is a comparative example.

Tests were carried out to compare the results provided by the activator-stabilizer 2-amino-2-thiazolinium trichloroacetate with the results provided by one activator-stabilizer bis(2-amino-2-thiazolinium) methylenebis(sulfonylacetate) in a heat developable, photographic composition as described in Example 1.

The photographic material containing the trichloroacetate compound demonstrated a greater than 10% loss of original maximum image density after incubation of the element for 3 days at 38° C and 50% relative humidity with the photographic layer side of the element in contact with a poly(ethylene terephthalate) film. (This was to simulate a roll of film).

The photographic material containing the sulfonylacetate compound demonstrated less than a 10% loss of original maximum image density after incubation for a week at 38° C and 50% relative humidity with the photographic layer side of the element in contact with a poly(ethylene terephthalate) film. (This was also to simulate a roll of film).

Higher gelatin levels, such as 350 mg or 500 mg, in the photographic composition of Example 1 do not significantly adversely affect the activity of the described stabilizer precursor according to the invention.

EXAMPLE 11

The following components were mixed with water to form a photothermographic composition. This was coated on a poly(ethylene terephthalate) film support at a wet coating thickness of 100 microns:

| | |
|---|---|
| photographic gelatin | 21.5 mg/dm² |
| surfactant (Surfactant 10G) | 1 mg/dm² |
| 4-hydroxymethyl-4-methyl-1-phenyl-3-pyrazolidone | 10.8 mg/dm² |
| $CH_3NHC(=O)NHCH_2CH_2N(CH_2CH_2OH)C(=O)NHCH_3$ (melt former) (known as N,N'-di(methylcarbamoyl)-2-(2-aminoethyl)aminoethanol and also named N-(methylcarbamoyl)-N-[2-(methylcarbamoylamino)ethyl]-2-aminoethanol) | 21.5 mg/dm² |
| 1,3-bis[2S-(N,N'-ethyleneisothiourea) ethyl]urea (referred to as ITU) (This compound can also be named as β,β'-ureylenebis(2-ethylthio-2-imidazoline)) | 25.8 mg/dm² |
| ethylenebis(sulfonylacetic acid) (referred to as EBSA) | 24.8 mg/dm² |
| silver bromoiodide gelatino photographic emulsion | 10.8 mgAg/dm² |

The resulting coating was permitted to dry at 43° C. It was then overcoated with 5.4 mg/dm² of poly(methyl methacrylate) from dichloromethane to provide a surface that was dry to the touch before and after processing. A sample of the resulting heat developable and heat stabilizable photographic element was sensitometrically exposed to white light to provide a latent image in the photographic layer. The element was then uniformly heated for 10 seconds at 160° C. A developed, purple-toned, light stable image was produced. The developed image had a white light, diffuse transmission maximum density of 1.8 and a minimum density of 0.13 with a gamma of 2.4.

Higher maximum density images were achievable with higher imagewise exposure levels of light.

The procedure described in this example was repeated with the exception that the element prior to imagewise exposure was incubated for 2 weeks at 38° C and 50% relative humidity. The resulting developed image after the incubation period exhibited no significant change in photographic speed and had a maximum diffuse density of 1.6 with a minimum density of 0.06. No evidence was observed of undesired crystallization of any of the components of the element. Each of the components of the element had desired low volatility at the incubation and processing temperatures that were used.

EXAMPLE 12

This is a comparative example.

The procedures described in Example 11 was repeated except that the ITU and EBSA components were omitted. Upon imagewise exposure and processing, as described, an image was developed having a maximum diffuse density of 0.75 and a minimum density of 0.18. The developed image was not light stable and provided a print-up density of 2.0 after 10,000 foot candle hours of illumination.

EXAMPLE 13

The following components were mixed with water to form a photothermograhic composition. This was coated on a poly(ethylene terephthalate) film support at a wet coating thickness of 100 microns:

| | |
|---|---|
| photographic gelatin | 21.5 mg/dm² |
| surfactant (Surfactant 10G) | 1 mg/dm² |
| 4-hydroxymethyl-4-methyl-1-phenyl-3-pyrazolidone | 10.8 mg/dm² |
| N,N'-di(methylcarbamoyl)-2-(2-aminoethyl)aminoethanol (melt former) | 21.5 mg/dm² |
| $[O{=}C(NHCH_2CH_2S{-}C(=NH)NH_2)]_2 \cdot CCl_3CO_2H$ | 47.3 mg/dm² |
| silver bromoiodide gelatino photographic emulsion (unsensitized, 0.12 micron grain size silver bromoiodide) | 10.8 mgAg/dm² |

The resulting coating was permitted to dry at 43° C. It was then overcoated with 5.4 milligrams per square decimeter of poly(ethyl methacrylate) from dichloromethane to provide a surface that was dry to the touch before and after processing. A sample of the resulting element was sensitometrically exposed as described in Example 11 to white light to provide a latent image in the photographic layer. The element was then uniformly heated for 10 seconds at 160° C. A developed light stable image having a maximum diffuse density of 0.92 and a minimum density of 0.07 was produced. A higher maximum density image was provided with the heat developable and heat stabilizable element of Example 11 compared to that provided by Example 13. The acid moiety of the isothiuronium compound influences the processing temperature and incubation stability rather than significantly influencing the sensitometry of the photographic material.

Heat developable and heat stabilizable photographic materials according to the invention containing the ITU and EBSA components have been observed to provide lower minimum density values than compositions containing bis(2-amino-2-thiazoline) methylenebis(sulfonylacetate) as described in Example 1. The heat developable and heat stabilizable material such as described in Example 1 provided desired incubation results after 2 weeks incubation at 38° C and 50% relative humidity provided that the bis(2-amino-2-thiazoline) methylenebis(sulfonylacetate) was observed to be crystallized. This crystallization often is difficult to insure with machine coating and with elements having an overcoat. The heat developable and heat stabilizable materials containing the ITU and EBSA components offer the advantage of not requiring crystallization for the described improved incubation properties. The 2-amino-2-thiazoline component is somewhat more volatile than the ITU component at normal processing temperatures.

EXAMPLE 14

The procedure described in Example 11 was repeated with the exception that the ITU component was replaced with the compound: 1,3-bis[2S-(N,N'-ethylene isothiourea)propyl]urea, that can also be named as γ,γ'-ureylenebis(2-propylthio-2-imidazoline), coated at a level of 27.4 milligrams/dm². The resulting heat developable and heat stabilizable element upon imagewise exposure and processing as described in Example 11 provided a light-stable, developed image having a diffuse, white light maximum density of 1.8 and a minimum density of 0.09. The image tone was purple.

This procedure was repeated with the exception that the element before imagewise exposure and processing was incubated for 1 week at 38° C and 50% relative humidity. The resulting element provided a developed image having a maximum density of 1.7 and a minimum density of 0.06.

EXAMPLE 15

The following components were mixed with water and coated on a poly(ethylene terephthalate) film support:

| | |
|---|---|
| photographic gelatin | 21.5 mg/dm² |
| surfactant (Surfactant 10G) | 1 mg/dm² |
| 4-methyl-4-hydroxymethyl-1-phenyl-3-pyrazolidone | 10.8 mg/dm² |
| silver bromoiodide gelatino emulsion (2.5 mole % iodide, unsensitized) | 10.8 mgAg/dm² |

The resulting layer was permitted to dry and then overcoated with the following using methanol as a solvent:

| | |
|---|---|
| hydroxypropyl cellulose (Klucel G sold by the Hercules Co., U.S.A.) | 21.5 mg/dm² |
| N,N'-di(methylcarbamoyl)-2-(2-aminoethyl)aminoethanol (melt former) | 16.9 mg/dm² |
| 1,3-bis[2S-N,N'-ethylene isothiourea)ethyl]urea (ITU) | 25.8 mg/dm² |
| ethylenebis(sulfonylacetic acid) (EBSA) | 22.6 mg/dm² |

This layer was permitted to dry and was then overcoated with 5.4 mg/dm² of poly(methyl methacrylate) from methylene chloride at 5.4 mg/dm².

The resulting heat developable and heat stabilizable photographic element was imagewise exposed to light to provide a latent image and then uniformly heated for 20 seconds at 160° C to provide a developed image. The resulting image was light stable and provided a diffused maximum density of 1.36 and a minimum density of 0.08.

EXAMPLE 16

The following components were mixed with water and coated on a poly(ethylene terephthalate) film support:

| | |
|---|---|
| photographic gelatin | 21.5 mg/dm² |
| surfactant (Surfactant 10G) | 1 mg/dm² |
| 4-methyl-4-hydroxymethyl-1-phenyl-3-pyrazolidone | 10.8 mg/dm² |
| 1,3-bis[2S-(N,N'-ethylene isothiourea)ethyl]urea (ITU) | 16.1 mg/dm² |
| ethylenebis(sulfonylacetic acid) (EBSA) | 16.1 mg/dm² |
| guanidinium ethylenebis(sulfonylacetate) | 16.1 mg/dm² |
| silver bromoiodide gelatino photographic emulsion (2.5 mole % iodide, unsensitized) | 10.8 mgAg/dm² |

The resulting layer was permitted to dry and was then overcoated with 5.4 mg/dm² of poly(methyl methacrylate) from methylene chloride.

The resulting heat developable and heat stabilizable photographic element was sensitometrically exposed with light to provide a latent image and then processed by uniformly heating the element for 15 seconds at 160° C. A deep purple light stable developed image was produced having a maximum density of 2.05 and a minimum density of 0.11 with a gamma of 2.8 (diffuse).

The procedure described in this example is repeated with the exception that prior to imagewise exposure the element was incubated for 2 weeks at 38° C and 50% relative humidity. The resulting developed image had a diffuse maximum density of 1.7 and a minimum density of 0.05.

EXAMPLE 17

The following components were mixed with water and coated on a poly(ethylene terephthalate) film support:

| | |
|---|---|
| photographic gelatin | 21.5 mg/dm² |
| surfactant (Surfactant 10G) | 1 mg/dm² |
| 4-methyl-4-hydroxymethyl-1-phenyl-3-pyrazolidone | 10.8 mg/dm² |
| 1,3-bis[2S(N,N'-ethyleneisothiourea)ethyl]urea (ITU) | 15.7 mg/dm² |
| ethylenebis(sulfonylacetic acid) (EBSA) | 16.1 mg/dm² |
| silver bromoiodide gelatino photographic emulsion (2.5 mole % iodide, unsensitized) | 10.8 mgAg/dm² |
| 1,3-bis(2-amino-2-thiazolinyl) propane ethylenebis(sulfonylacetate) | 21.5 mg/dm² |

The resulting coating was permitted to dry to provide the desired heat developable and heat stabilizable photographic element. The element was imagewise exposed to light to provide a latent image and was then uniformly heated for 11 seconds at 160° C to provide a developed and stabilized image. The resulting image had a diffuse maximum density of 1.7 and a minimum density of 0.1 with a gamma of 2.4.

The procedure was repeated with the exception that the element prior to imagewise exposure was incubated for 2 weeks at 38° C and 50% relative humidity. The resulting developed image had a maximum density of 1.6 and a minimum density of 0.06.

The procedure of the example was repeated with the exception that the film support contained a black antihalation backing on the side opposite the photographic coating. The developed image resulting provided an image resolution of 250 lines per millimeter.

EXAMPLE 18

The procedure described in Example 11 was repeated with the exception that the pyrazolidone compound was replaced with 2-isopropyl-4,5,6-trihydroxypyrimidine as a developing agent.

The resulting developed image had a maximum density of 1.1 and a minimum density of 0.04. The developed image was stable to light.

EXAMPLE 19

This is a comparative example.

The procedure described in Example 11 was repeated with the exception that N-[2-(ethyleneisothiuronium)ethyl]-N'-methylurea trichloroacetate was used in place of ITU and EBSA as described in Example 11. Upon processing a developed image was produced having a maximum density of 1.3 and a minimum density of 0.40.

The invention has been described in detail with particular reference to preferred embodiments thereof, but it will be understood that variations and modifications can be effected within the spirit and scope of the invention.

What is claimed is:

1. In a heat developable and heat stabilizable photographic element comprising a support having thereon, in reactive association, (a) a photographic silver salt, (b)

a photographic silver salt developing agent, (c) a binder, and (d) a stabilizing concentration of an activator-stabilizer precursor having a base portion and an acid portion the improvement wherein said acid portion is an alpha-sulfonylacetate.

2. A heat developable and heat stabilizable photographic element comprising a support having thereon in reactive association (a) a photographic silver salt, (b) a photographic silver salt developing agent, (c) a binder, and (d) a stabilizing concentration of an activator-stabilizer precursor represented by the formula:

$$Q_mA_w$$

wherein Q is a protonated basic nitrogen containing moiety; A is an alpha-sulfonylacetate; $m$ is 1 to 4 and $w$ is 1 to 2.

3. The element of claim 2 wherein A is an alphasulfonylacetate represented by the formula:

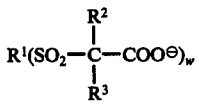

wherein $w$ is 1 or 2;

$R^1$ is alkyl containing 1 to 6 carbon atoms, aryl containing 5 to 10 carbon atoms or carboxymethyl when $w$ is 1, and alkylene containing 1 to 6 carbon atoms, alkylidene, or arylene containing 6 to 10 carbon atoms when $w$ is 2;

$R^2$ and $R^3$ individually are hydrogen, alkyl containing 1 to 6 carbon atoms or aryl containing 6 to 10 carbon atoms.

4. The element of claim 2 wherein Q is selected from the group consisting of the following formulas:

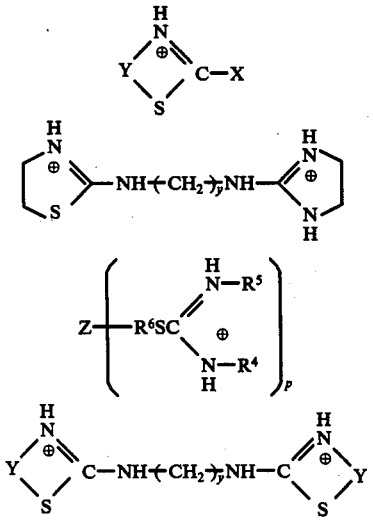

wherein

Y is alkylene containing 2 or 3 chain carbon atoms,

X is $SR^7$ or $NHR^8$, wherein $R^7$ is aminoalkyl containing 2 to 6 carbon atoms, and $R^8$ is hydrogen, alkyl containing 1 to 20 carbon atoms, phenyl, or aminoalkyl containing 2 to 6 carbon atoms;

$p$ is 1 or 2;

when $p$ is 1, Z is

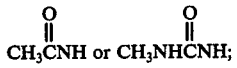

when $p$ is 2, Z is a divalent linking group selected from the group consisting of

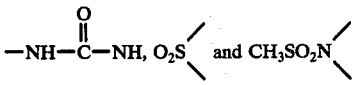

$R^6$ is alkylene containing 2 to 12 carbon atoms, or phenylene;

$R^5$ and $R^4$ are individually selected from the group consisting of hydrogen, alkyl containing 1 to 6 carbon atoms, or $R^5$ and $R^4$ taken together represent alkylene containing 2 or 3 carbon atoms;

$y$ is 1 to 8.

5. The element of claim 1 wherein the activator-stabilizer precursor has the properties of releasing a byproduct by decarboxylation upon heating and undergoes less than 10% weight loss in a thermogravimetric scan between about 30° C and about 180° C where the scan rate is about 40° C per minute.

6. The element of claim 1 wherein said acid portion is selected from the group consisting of ethylenebis(sulfonylacetate), methylenebis(sulfonylacetate) and phenylsulfonylacetate.

7. The element of claim 1 wherein the activator-stabilizer precursor consists essentially of bis(2-amino-2-thiazoline) methylene(sulfonylacetate).

8. The element of claim 1 wherein the activator-stabilizer precursor consists essentially of N-(2-thiazoline)-N'-(imidazoline)ethylenediamine ethylenebis(sulfonylacetate).

9. The element of claim 1 wherein the activator-stabilizer precursor consists essentially of 1,3-bis[2S-(N,N'-ethyleneisothiourea)ethyl]urea ethylenebis(sulfonylacetate.

10. The element of claim 1 wherein the photographic silver salt is photographic silver halide.

11. The element of claim 1 wherein the stabilizing concentration of the activator-stabilizer precursor is 0.2 to 4 moles of the activator-stabilizer precursor per mole of the photographic silver salt.

12. A heat developable and heat stabilizable photographic element comprising a support having thereon a layer comprising in reactive association (a) photographic silver halide, (b) a 3-pyrazolidone silver halide developing agent, (c) a polymeric binder, and (d) a stabilizing concentration of an activator-stabilizer precursor comprising bis(2-amino-2-thiazoline) methylene(sulfonylacetate).

13. A heat developable and heat stabilizable photographic element comprising a support having thereon a layer comprising in reactive association (a) photographic silver halide, (b) a 3-pyrazolidone silver halide developing agent, (c) a polymeric binder and (d) a stabilizing concentration of an activator-stabilizer precursor comprising N-(2-thiazolino)-N'-(imidazolino)ethylenediamine ethylenebis(sulfonylacetate).

14. In a heat developable and heat stabilizable photographic composition comprising (a) a photographic silver salt, (b) a photographic silver salt developing agent and (c) a stabilizing concentration of an activator-stabilizer precursor having an acid portion and a base portion the improvement wherein said acid portion is an alpha-sulfonylacetate.

15. A heat developable and heat stabilizable photographic composition comprising (a) a photographic silver salt, (b) a photographic silver salt developing agent, and (c) a stabilizing concentration of an activator-stabilizer precursor represented by the formula:

$$Q_m A_w$$

wherein Q is a protonated basic nitrogen containing moiety; A is an alpha-solfonylacetate; *m* is an integer from 1 to 4 and *w* is an integer 1 to 2.

16. The composition of claim 15 wherein A is an alpha-sulfonylacetate represented by the formula:

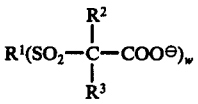

wherein

*w* is 1 or 2;

$R^1$ is alkyl containing 1 to 6 carbon atoms, aryl containing 5 to 10 carbon atoms or carboxymethyl when *w* is 1, and alkylene containing 1 to 6 carbon atoms, alkylidene, or arylene containing 6 to 10 carbon atoms when *w* is 2;

$R^2$ and $R^3$ individually are hydrogen, alkyl containing 1 to 6 carbon atoms or aryl containing 6 to 10 carbon atoms.

17. The composition of claim 15 wherein Q is selected from the group consisting of the following formulas:

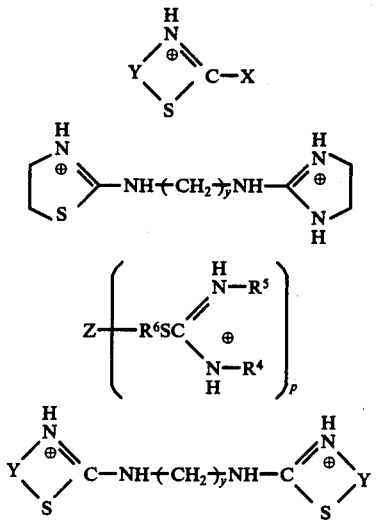

wherein

Y is alkylene containing 2 or 3 chain carbon atoms,

X is $SR^7$ or $NHR^8$, wherein $R^7$ is aminoalkyl containing 2 to 6 carbon atoms, and $R^8$ is hydrogen, alkyl containing 1 to 20 carbon atoms, phenyl, or aminoalkyl containing 2 to 6 carbon atoms;

*p* is 1 or 2;

when *p* is 1, Z is

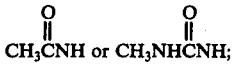

when *p* is 2, Z is a divalent linking group selected from the group consisting of

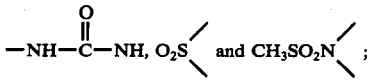

$R^6$ is alkylene containing 2 to 12 carbon atoms, or phenylene;

$R^5$ and $R^4$ are individually selected from the group consisting of hydrogen, alkyl containing 1 to 6 carbon atoms, or $R^5$ and $R^4$ taken together represent alkylene containing 2 or 3 carbon atoms;

*y* is 1 to 8.

18. The composition of claim 15 wherein the activator-stabilizer precursor has the properties of releasing a byproduct by decarboxylation upon heating and undergoes less than 10% weight loss in a thermogravimetric scan between about 30° and about 180° C where the scan rate is about 40° C per minute.

19. The composition of claim 15 wherein said acid portion is selected from the group consisting of ethylenebis(sulfonylacetate), methylenebis(sulfonylacetate) and phenylsulfonylacetate.

20. The composition of claim 15 wherein the activator-stabilizer precursor consists essentially of bis(2-amino-2-thiazoline) methylene(sulfonylacetate).

21. The composition of claim 15 wherein the activator-stabilizer precursor consists essentially of N-(2-thiazolino-N'-(imidazolino)ethylenediamine ethylenebis(sulfonylacetate.

22. The composition of claim 15 wherein the activator-stabilizer precursor consists essentially of 1,3-bis[2S-(N,N'-ethyleneisothiourea)ethyl]urea ethylenebis(sulfonylacetic acid).

23. The composition of claim 15 wherein the stabilizing concentration of the activator-stabilizer precursor is 0.2 to 4 moles of the activator-stabilizer precursor per mole of the photographic silver salt.

24. A heat activatable photographic silver salt processing composition comprising a silver salt developing agent and an activator-stabilizer precursor wherein said stabilizer precursor has the formula:

$$Q_m A_w$$

wherein Q is a protonated basic nitrogen containing moiety; A is an alpha-sulfonylacetate; *m* is an integer from 1 to 4 and *w* is an integer 1 to 2 and wherein said precursor is present in the composition in a concentration sufficient to stabilize a silver halide image when said composition is heated.

25. The processing composition of claim 24 wherein said developing agent comprises a phenolic silver halide developing agent and a 3-pyrazolidone silver halide developing agent and wherein said activator-stabilizer precursor is a compound selected from the group consisting of bis(2-amino-2-thiazoline) methylene(sulfonylacetate), N-(2-thiazolino)-N'-(imidazolino)ethylenediamine ethylenebis(sulfonylacetate), 1,3-bis[2S-(N,N'-ethyleneisothiourea)ethyl]urea ethylenebis(sulfonylacetic acid) and combinations thereof.

26. A heat activatable photographic silver salt processing composition comprising (a) a hydroquinone silver halide developing agent, (b) a 4-methyl-4-hydroxymethyl-1-phenyl-3-pyrazolidone silver halide developing agent and (c) N-(2-thiazolino)-N'-(imidazolino)ethylenediamine ethylenebis(sulfonylacetate).

27. A method of developing and stabilizing an image in an exposed photographic element as defined in claim 1, after image wise exposure comprising heating said element to a temperature within the range of about 90° to about 200° C until an image is developed and stabilized.

28. The method of claim 27 wherein the element is heated for about 1 to 60 seconds.

* * * * *

UNITED STATES PATENT AND TRADEMARK OFFICE

CERTIFICATE OF CORRECTION

PATENT NO. : 4,060,420

DATED : November 29, 1977

INVENTOR(S) : Paul B. Merkel and Hans G. Ling

It is certified that error appears in the above-identified patent and that said Letters Patent are hereby corrected as shown below:

Column 2, line 40, "information" should read ---formation---.

Column 4, line 11, "theylenebis(sulfonylacetate)" should read ---ethylenebis(sulfonylacetate)---.

Column 6, line 46, "then" should read ---than---.

Column 8, line 28, "31-pyrazolidone" should read --- 3-pyrazolidone ---.

Column 10, line 65, "ncessary" should read ---necessary---.

Column 15, line 59, "immediate" should read ---imagewise---.

Column 23, line 10, "alpha-solfonylacetate" should read --- alpha-sulfonylacetate ---.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*